343-909 SR
10/23/84 XR 4,479,131

United States Patent [19]
Rogers et al.

[11] Patent Number: 4,479,131
[45] Date of Patent: Oct. 23, 1984

[54] THERMAL PROTECTIVE SHIELD FOR ANTENNA REFLECTORS

[75] Inventors: James E. Rogers, Woodland Hills; James S. Warniak; Lowell M. Hobrock, both of Los Angeles; Michael A. Bafico, Lawndale; Stephen R. Scheele, Woodland Hills, all of Calif.

[73] Assignee: Hughes Aircraft Company, El Segundo, Calif.

[21] Appl. No.: 399,648

[22] Filed: Jul. 19, 1982

Related U.S. Application Data

[63] Continuation of Ser. No. 191,050, Sep. 25, 1980, abandoned.

[51] Int. Cl.[3] ..... H01Q 1/40
[52] U.S. Cl. ..... 343/872; 343/909
[58] Field of Search ..... 343/872, 909, 18 R, 343/18 A, 18 B

[56] References Cited

U.S. PATENT DOCUMENTS

| | | | |
|---|---|---|---|
| 3,295,131 | 12/1966 | Hollingsworth | 343/909 |
| 3,394,378 | 7/1968 | Williams et al. | 343/779 |
| 3,396,400 | 8/1968 | Kelly et al. | 343/909 |

*Primary Examiner*—Eli Lieberman
*Attorney, Agent, or Firm*—Lewis B. Sternfels; A. W. Karambelas

[57] ABSTRACT

A sun shield (16) is placed in front of an RF reflector (12) for thermal protection thereof. The shield comprises a Kapton substrate (20) with a thin aluminum capacitive grid (26) on the shield's reflector side (24), and a partially reflecting layer (28) of germanium on its sun side (22). Other materials and combinations thereof may be placed on either or both sides singly or in layers to obtain desired reflectance and thermal energy rejection away from the reflector.

5 Claims, 6 Drawing Figures

THERMAL PROTECTIVE SHIELD FOR ANTENNA REFLECTORS

CROSS-REFERENCE TO RELATED INVENTION

This is a continuation of copending application, Ser. No. 191,050 filed Sept. 25, 1980, now abandoned.

BACKGROUND OF THE INVENTION

1. Field of the Invention

The present invention relates to shielding of antenna reflectors from heat and, in particular, to protecting such reflectors from distortion caused by solar heating.

2. Description of the Prior Art

The directionality of antenna reflectors is dependent upon how well their curvature can be maintained free from distortion, a major cause of which is solar heating, or the uneven shading and exposure to solar energy.

In conventional methods for controlling thermal distortion, Kapton is coated on one side with white paint. Such a structure is primarily deficient in that it can not fully control solar generated thermal distortion and in that its use results in high RF losses.

SUMMARY OF THE INVENTION

These and other problems are overcome and avoided by the present invention, which comprises a substrate transparent to the radio-frequency (RF) electromagnetic energy to the reflected and, in general, a combination of deposited materials on the substrate which, while remaining substantially transparent to the electromagnetic energy, substantially rejects the solar energy. Specifically, one type of deposited material reflects the majority of the solar energy, while another type absorbs and re-radiates the energy. The preferred material for solar reflection comprises a capacitive grid, while the absorbing and heat rejecting material comprises a semiconductor material.

Advantages, therefore, of the present invention are (1) the reduction of thermally induced deformations in, and uneven thermal exposure to, an antenna RF reflector, (2) the provision for high solar reflection from a shield away from the antenna reflector, as viewed from its sun side, (3) the provision for high thermal emittance from such a shield, also as viewed from its sun side, and for low thermal emittance from the shield's reflector side, (4) the provision for radiation of heat towards space, (5) the provision for such a sun shield having very low solar transmittance, (6) the enablement of such a sun shield to be independent of RF polarization, and (7) the provision for a sun shield whose design can be tailored to its intended environment.

Other aims and advantages as well as a more complete understanding of the present invention will appear from the following explanation of exemplary embodiments and the accompanying drawings thereof.

DETAILED DESCRIPTION OF THE INVENTION

Figure 1:
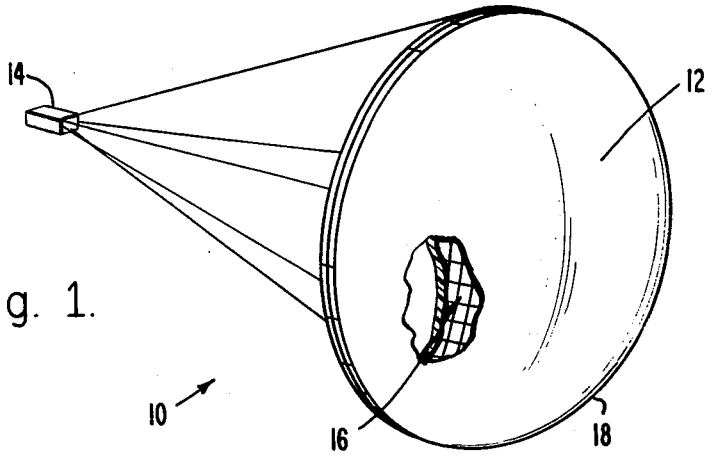
FIG. 1 is a perspective view of an antenna construction with a cut-away portion showing the inventive sun shield in place.

FIG. 1 illustrates an antenna arrangement 10 comprising a conventional reflector 12 of parabolic configuration, in which electromagnetic energy is to be reflected from or to the reflector's focus with, for example, one or more RF feed horns or receivers 14 being positioned at the focus of the reflector. Thus, antenna 10 may be viewed either as a transmitter or a receiver of radio frequency or other electromagnetic energy. So long as reflector 12 maintains its parabolic shape, signals will be appropriately received or transmitted by receiver or transmitter 14. The reflector's shape, however, is subject to deformations caused by uneven heating due to shading from and exposure to solar or other energy on the front or solar side of the reflector. Control of differential heating and cooling on the backside of the reflector is conventionally controlled by use of standard thermal insulation and creates no further problems of concern to the present discussion. Such standard thermal insulation is also opaque to radio frequency energy and, therefore, the insulation is complete. However, it is not possible to place standard insulation on the front side of the reflector; otherwise, the reflector would be incapable of properly transmitting the electromagnetic energy impinging thereon.

The present invention solves this problem by placing a shield 16 in front, or on the solar facing side, of the reflector. The shield is attached to the reflector's circumference 18 by any conventional means, such as by adhesives and the like.

Figure 2:
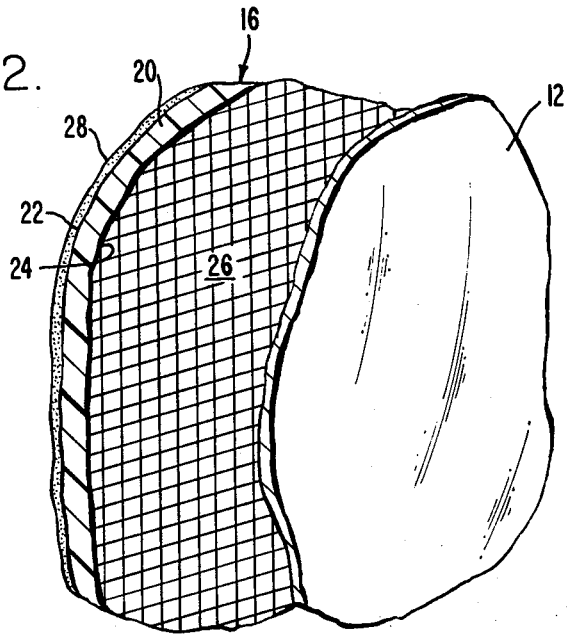
FIG. 2 is an enlarged view of the cut-away portion depicted in FIG. 1.

As shown in greater detail in FIG. 2, shield 16 comprises a substrate 20 which is transparent to the RF energy, or any other energy which is to be reflected from reflector 12. One or more coatings are placed on one or both sides of the substrate for substantially rejecting the solar energy, or for removing or radiating heat generated thereby, while the substrate and the coatings remain substantially transparent to the electromagnetic energy.

Specifically, the conditions placed on the shield may be categorized as follows, the examples below being given only as illustrative criteria:

(1) the shield must be transparent to RF energy (e.g. less than 0.1db average loss and 0.2db maximum loss at any frequency;

(2) the shield mush have high solar reflectance (e.g. 54%) and relatively low absorption (e.g. 44%) as viewed from its front or solar facing side 22;

(3) the shield must have high thermal emittance at its operating temperature (e.g. 300° K) as viewed from its front side;

(4) the shield must have low thermal emittance from its back or reflector facing side 24; and (5) the shield must have a very low solar transmittance (e.g. 2%) through it to the antenna.

These conditions are based upon the fact that any reflective material of solar energy, which is placed on sun side 22 of the substrate, does not, as limited by the physical characteristics of the materials available, reflect 100% of the energy. Thus, some solar energy is absorbed by the shield and, to prevent heating thereof and ensuing heating of reflector 12, it is necessary to radiate such absorbed heat back into space and away from the antenna reflector.

Accordingly, in a preferred embodiment of the present invention, a capacitive grid 26 is placed on the back or reflector side 24 of the substrate, while a semiconductive layer 28 is placed on its front or sun side 22. In particular, where the electromagnetic energy comprises RF energy, and the radiation causing potential antenna reflector thermal distortion comprises solar energy, the preferred materials of substrate 20 is Kapton (trademark), of capacitive grid 26 is aluminum, and of semiconductive layer 28 is germanium. Other materials may be used, as discussed presently.

To meet conditions (1), (2), (5) above, capacitive grid 26 is designed to be highly transparent to RF energy, while having high solar reflectance and low solar transmittance. The fact that it is capable of having high solar reflectance under condition (2) adds to its ability to have very low solar transmittance under condition (5). Such a capacitive grid has been used for IR filters, in which a grid was placed on an RF opaque substrate. Prevailing thinking by experts having RF and thermal physics backgrounds indicated that use of such a grid from IR filters for a capacitive grid for an antenna reflector shield would not work; however, the inventors herein discovered otherwise. Thus, success in the practice of the present invention proves that such prevailing opinion was incorrect.

Figure 3:
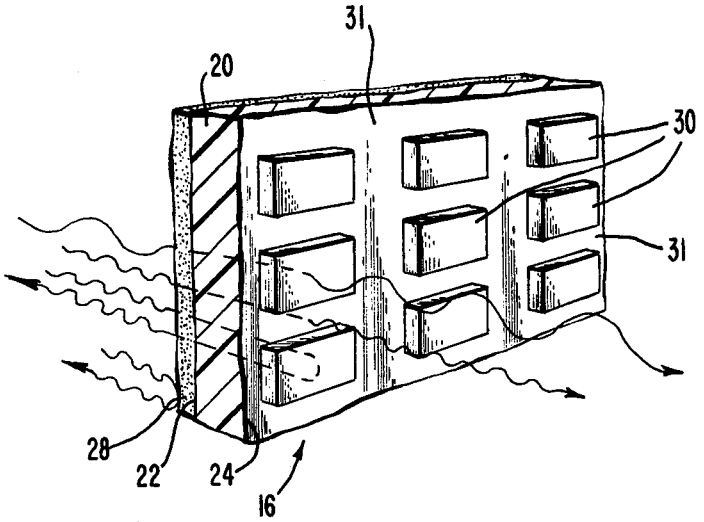
FIG. 3 is an enlarged perspective view in section of the shield illustrated in FIG. 2.

The present invention as used, for example, for an 11–15 GHz RF antenna incorporates the following materials and dimensions. It will be appreciated that the materials and dimensions will vary according to other specific uses. The preferred material of the capacitive grid comprises aluminum which is vacuum deposited on the Kapton substrate in a conventional manner to an approximate thickness of 1500±400 Å. After being vacuum deposited, portions of the aluminum material are removed by conventional etching techniques to form a plurality of pads 30 (see FIG. 3) arranged in a grid pattern of 100 micrometers center-to-center with nominal spacings between the pads of 7 micrometers. To assure uniformity in the arrangement and spacing, the substrate is held flat on a vacuum table so that the pattern of the etching process is evenly exposed. The thickness of the aluminum grid is not critical and only needs to be sufficiently this so that it can be etched. The grid needs to have a maximum thickness which is sufficiently thick to be opaque to solar energy, i.e., so that an essentially unmeasurable amount of solar energy passes through the aluminum.

While aluminum is preferred, any other metal having the best properties to achieve conditions (1), (2) and (4) may be used. If the properties desired for RF transmission and solar energy reflectance under other conditions are required, other materials may be utilized. For example, if low thermal emittance as veiwed from the reflector side were a condition of overriding importance, the preferred material for the capacitive grid would be gold. On the other hand, if very low solar absorptance as view from the sun side of the shield were the most important condition, then the preferred material for the capacitive grid would be silver.

In addition to the above, the spacing between the pads and their size are important, and must be selected carefully to obtain the desired RF properties, in particular, RF transmittance. Specifically, to obtain maximum RF transmission, no aluminum would be used at all; thus there would be no pads. On the other hand, the pads are required to reduce the solar transmittance, and the optimum case would be the use of a continuous aluminum coating. In practice, therefore, the application of the antenna dictates that would be the acceptable compromise between the two.

Figure 4:
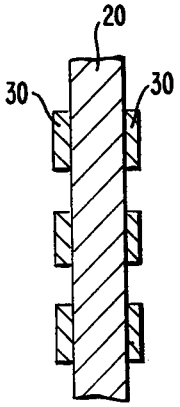

Also, if the application so requires, a capacitive grid may be placed also on sun side 22 as well as on reflector side 24 of substrate 20 (see FIG. 4) or, if desired, solely on the sun side thereof. If a pair of capacitive grids were placed on both sides, contrary to conventional thinking in the relevant arts that there must be perfect alignment between front and back capacitive grids, it was discovered that any orientation of one to the other would nevertheless result in a reduction in solar transmittance without significant RF attenuation. Thus, the pad size and the ratio of clear to opaque areas between the front and back grids could be relaxed to improve the RF performance while the second grid improves the solar performance.

With respect to condition (3) above, germanium, which operates as an optical coating, was found to be the preferred material as coating or layer 28 for reducing solar transmittance as viewed from the sun side of the substrate. Thus, it operates as an optical interference filter. In addition, since coating 28 comprises a semiconductor material, it acts favorably to bleed off any space charge on the shield as well as to protect the substrate from deterioration caused by solar ultraviolet rays. Such an optical coating is prefereably adhered to the substrate by vacuum deposition to approximately 1600 Å, with a maximum tolerance of 20%. The thickness of this coating is such that, if it were too thick, the front surface emittance would drop and, it it were too thin, the solar transmittance would increase. Such criticality is dependant upon the characteristics of the particular material used. However, because germanium is one of the easiest materials to coat on Kapton, it is preferred for the above noted 11–15 GHz application. It is additionally preferred over, for example, silicon, because it has a higher conductivity than silicon and, therefore, better able to conduct away the space charge. Nevertheless, silicon and other materials, such as indium antimonide, lead telluride and cadmium telluride in single layers can be used in place of germanium in order to tailor the properties under conditions (3) and (5) to the needs for which the shield are used.

Figure 5:
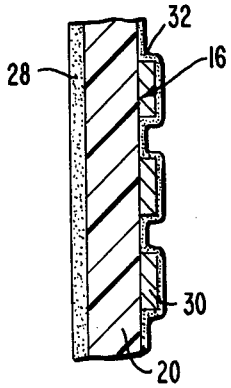
FIGS. 4–6 are cross-sectional views of three modifications of the shield shown in FIG. 3.

In addition, single layer materials may be placed either on the sun side or reflector side of the substrate to improve transmission characteristics or to reduce additionally the space charge. For example, as shown in FIG. 5, a front coating 28 of germanium may be combined with a reflector side coating 32 of cadmium telluride. Such a combination of semiconductor materials decreases the solar energy transmission as compared to a single layer and, in addition, cadmium telluride offers lower reflector side thermal emittance than germanium. It is obvious, therefore, that the various semiconductive optical coating materials can be combined or rearranged in order to obtain different thermal modeling for a particular use of the antenna.

Figure 6:
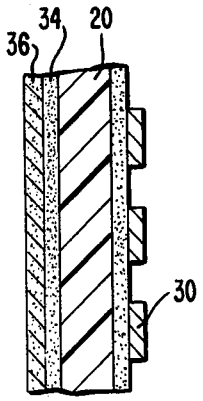

While optical coating 32 is shown in FIG. 5 on top of capacitive grid 16, such placement is simply a matter of ease in manufacturing processing. However, on the other hand, placement of the capacitive grid on top of the optical coating, as depicted in FIG. 6, permits greater flexibility in the use of the material and the thickness of the coating, without affecting the thermal emittance. Thus, the conditions and the steps by which the shield is manufactured can be tailored to what is desired.

Furthermore, as shown in FIG. 6, the semiconductor optical coating may be multilayered as illustrated by a pair of semiconductor layers 34 and 36, which act as an interference filter to achieve different optical and thermal characteristics. These multilayers, although shown on the sun side of substrate 20, may be placed on the back or reflector side or may be placed in single or double layers on both sides of the substrate to increase the reflectance characteristics. While double multilayers are depicted, more than two layers may be used. Examples of combinations of materials include germanium and silicon monoxide, and zinc sulphide, thorium tetrafluoride and silver. Again, contrary to accepted opinion which represented that such layers could not be placed on Kapton because they would deform the substrate, experience in the making of the present invention showed that care in their application in fact permits a combination of such materials.

While substrate 20 is preferred to be made of Kapton as being easily available for such large structures having about a 6 foot (1.83 m) diameter, and because it is space qualified to withstand high temperatures and to obtain easy adherence of aluminum and germanium thereto, other substrate materials may be used. Such materials include Mylar and Teflon, although adherence thereto is not as good as with Kapton and include some processing or manufacturing difficulties not present with Kapton.

Also, if weight is not a problem, glass or quartz may be utilized as a substrate material. However, nonrigid materials are preferred as being more easily deployable, as they are capable of being folded.

Although the invention has been described with reference to particular embodiments thereof, it should be realized that various changes and modifications may be made therein without departing from the spirit and scope of the invention.

What is claimed is:

1. A shield for protecting an antenna reflector of electromagnetic energy against thermal distortion from solar energy, comprising:

a substrate transparent to the electromagnetic energy placed between the reflector and the solar energy; and at least two means on said substrate for substantially rejecting the solar energy while remaining substantially transparent to the electromagnetic energy, a first of said means comprising a capacitive grid rejecting a major portion of the solar energy and a second of said means comprising an optical interference filter of matter capable of absorbing and re-radiating substantially the remainder of the solar energy;

in which said grid comprises predeterminately sized pads of metal with spacing therebetween, with the size of said pads and said spacing, and the ratio of pad and spacing area being respectively adjusted to optimize respectively the transmittance of the electromagnetic energy and the reflectance of the solar energy, and to obtain a balance therebetween; and in which said substrate has sun and reflector sides respectively facing away from and towards said reflector, and further comprising a second metallic capacitive grid formed similarly as said first-mentioned grid, said first and second grids being placed respectively on said substrate sun and reflector sides, with the center-to-center spacing respectively between said first and second grids being adjusted to optimize the electromagnetic tranmittance and solar energy reflectance.

2. A shield for protecting an antenna reflector of electromagnetic energy against thermal distortion from solar energy, comprising:

a substrate transparent to the electromagnetic energy placed between the reflector and the solar energy; and at least two means on said substrate for substantially rejecting the solar energy while remaining substantially transparent to the electromagnetic energy, a first of said means comprising a capacitive grid rejecting a major portion of the solar energy and a second of said means comprising a semiconductor layer facing away from said reflector, said semiconductor layer comprising an optical interference filter capable of absorbing and re-radiating substantially the remainder of the solar energy.

3. A shield according to claim 2 in which said grid and said semiconductor layer are placed on opposite sides of said substrate.

4. A shield according to claim 3, in which said means further includes a second semiconductor layer placed on the same substrate side as said grid.

5. A shield according to claims 2, 3, or 4 in which said means further includes one or more additional semiconductor layers placed atop said first-mentioned semiconductor layer.

* * * * *